United States Patent [19]

Holford

[11] 4,154,149

[45] May 15, 1979

[54] CIRCULAR DIFFUSER FOR VENTILATING SYSTEMS

[76] Inventor: Frederick R. Holford, 27a, Church Rd., Cowley, Uxbridge, Middlesex, England

[21] Appl. No.: 820,787

[22] Filed: Aug. 1, 1977

[30] Foreign Application Priority Data

Aug. 16, 1976 [GB] United Kingdom ..... 34022/76

[51] Int. Cl.[2] ..... F24F 13/06

[52] U.S. Cl. ..... 98/40 B; 74/469; 74/520

[58] Field of Search ..... 98/40 B; 74/520, 469

[56] References Cited

U.S. PATENT DOCUMENTS

| | | | |
|---|---|---|---|
| 2,603,141 | 7/1952 | Phillips et al. | 98/40 B |
| 2,607,282 | 8/1952 | Gilbert | 98/40 B |
| 2,737,106 | 3/1956 | Kennedy | 98/40 B |
| 2,772,624 | 12/1956 | Carnes | 98/40 B |
| 2,780,980 | 2/1957 | Kennedy | 98/40 B |
| 3,134,882 | 5/1964 | Mogilner | 74/520 X |

FOREIGN PATENT DOCUMENTS

| | | | |
|---|---|---|---|
| 1184167 | 12/1964 | Fed. Rep. of Germany | 74/469 |

*Primary Examiner*—James Kee Chi

*Attorney, Agent, or Firm*—Ralph B. Pastoriza

[57] ABSTRACT

A circular or polygonal diffuser for ventilating systems, comprising an annular outer diffuser cone or pyramid adapted to be fixedly mounted in a ceiling of a room to be ventilated, and an inner diffuser cone or pyramid assembly which includes at least one diffuser cone or pyramid of smaller dimensions than the outer diffuser cone or pyramid and which is connected to the outer cone or pyramid for axial adjustment relative thereto by means of parallelogram linkage devices having friction inducing means serving to retain the inner cone or pyramid assembly in the adjusted position.

7 Claims, 5 Drawing Figures

CIRCULAR DIFFUSER FOR VENTILATING SYSTEMS

This invention relates to a circular or polygonal diffuser for ventilating systems, of the kind comprising an annular outer diffuser cone or pyramid fixedly mountable in a ceiling of a room to be ventilated and one or more co-axially arranged inner diffuser cones or pyramids of smaller dimensions than said outer diffuser cone and which are connected to the outer cone or pyramid so as to be adjustable axially relative to the outer cone or pyramid for varying the volume of air flowing and for varying the air flow direction pattern at the outlet of the diffuser.

For the sake of brevity, in the following description, reference will only be made to "circular diffusers" and "diffuser cones". However, it is to be understood that such terms are intended to include polygonal diffusers and corresponding diffuser pyramids.

BACKGROUND OF THE INVENTION

In a previously known circular diffuser of the foregoing kind, one or more inner diffuser cones are provided which is or are axially adjustable relative to the outer diffuser cone by means of a screwthreaded spindle which is secured to the innermost cone at one end and at the other end engages rotatably in a central web secured to the outer diffuser cone. By rotating the innermost cone, which is in the form of a frusto-cone in one or the other direction the spindle screws into or out of the central web, whereby the relative axial distance between the outer cone and the inner cone or the assembly of inner cones is varied as desired. While such construction serves its purpose, it is rather slow and cumbersome in operation.

SUMMARY OF THE INVENTION

The present invention aims at providing a circular diffuser of an improved construction, which facilitates quicker and easier adjustment of the movable parts of the diffuser, and to this end consists in a circular diffuser (as herein defined) for ventilating systems, comprising a fixedly mountable outer diffuser cone, an inner diffuser cone assembly movably mounted within said outer diffuser cone for adjustment co-axially thereto and including at least one diffuser cone of smaller dimensions than said outer diffuser cone, and parallelogram linkage devices each pivotally connecting respectively at diagonally opposite vertices the inner diffuser cone assembly to the outer diffuser cone and including friction inducing means, whereby to cause the inner cone assembly to remain in position after effecting an adjustment thereof relative to the outer diffuser cone.

Advantageously, at least three said parallelogram linkage devices are provided which are arranged in uniformly spaced apart angular relationship. Each said parallelogram linkage device is preferably pivotably mounted at one end or vertex by means of a bolt and nut assembly on an angle bracket secured to the inner diffuser cone assembly and at the other end or diagonally opposite vertex by means of a further bolt and nut assembly on a further angle bracket which slidably engages in an anchoring bracket secured to the outer diffuser cone. Conveniently, a releasable catch in the form of a leaf spring secures the brackets of the inner cone assembly in position within the anchoring brackets. The friction inducing means are preferably constituted by crinkled washers or axially compressible bushes which are carried by the bolts of the linkage devices.

BRIEF DESCRIPTION OF THE DRAWINGS

In order that the invention may be more readily understood, reference is made to the accompanying drawings which illustrate diagrammatically and by way of example embodiments thereof and in which.

DETAILED DESCRIPTION OF THE DRAWINGS

Figure 1:
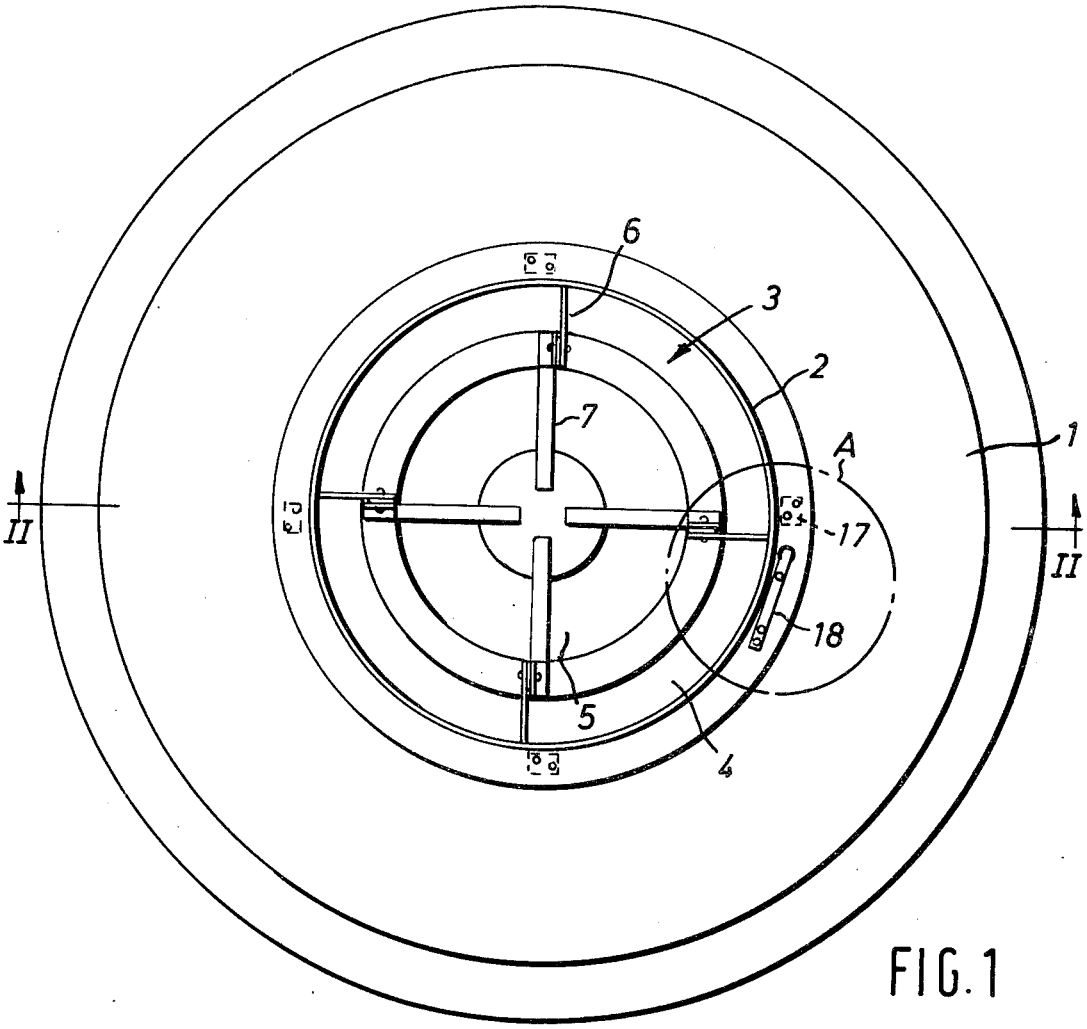
FIG. 1 is a top plan view of a circular diffuser in accordance with the invention.
Figure 4:
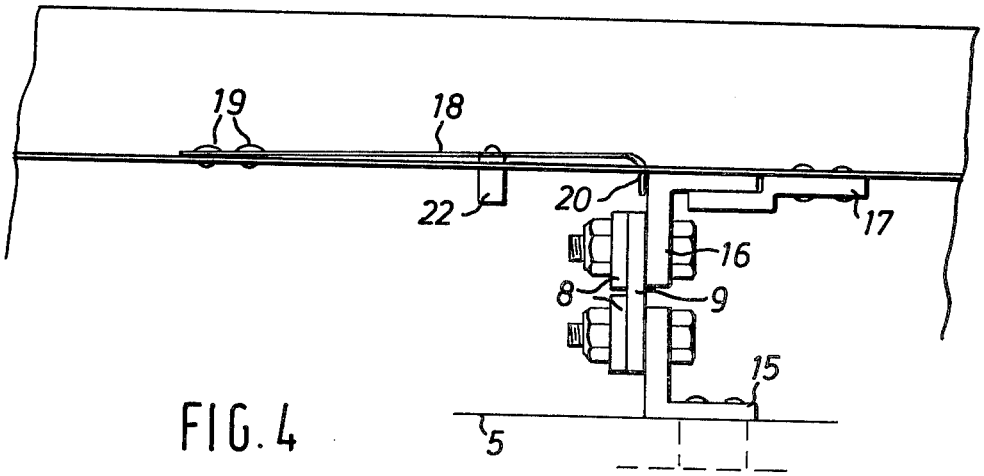
FIG. 4 is an elevation of detail "A" of FIG. 1.

The circular diffuser illustrated comprises an outer annular diffuser cone 1 which has an outwardly extending neck or flange 2 at its inner periphery by means of which neck the diffuser is adapted to be fixedly mounted at the outlet end of a ventilating duct in the ceiling of a room to be ventilated. In such arrangement the neck 2 of the diffuser may be connected, for example rivetted, to a sleeve carrying a ventilating damper of known construction. An inner diffuser cone assembly 3, comprising an annular cone 4 of smaller dimensions than the outer cone 1 and a frusto-cone 5 of smaller dimensions than the smaller annular cone 4, is movably mounted within said outer cone 1 by means of four uniformly angularly spaced apart parallelogram linkages 6 for adjustment co-axially in relation to the outer cone 1. The two diffuser cones 4 and 5 of the inner cone assembly 3 are rigidly connected together in axially spaced apart relationship by four angularly equi-distant spaced arms 7, with the smaller annular cone 4 being located between the outer annular cone 1 and the frusto-cone 5.

Figure 5:
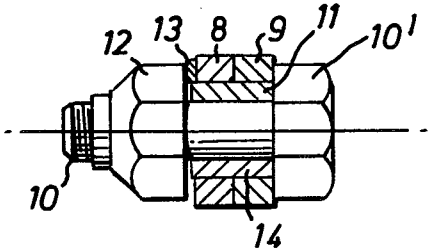
FIG. 5 is a fragmentary view through a bolt of the parallelogram linkage devices showing two embodiments of the friction inducing means.
Figure 3:
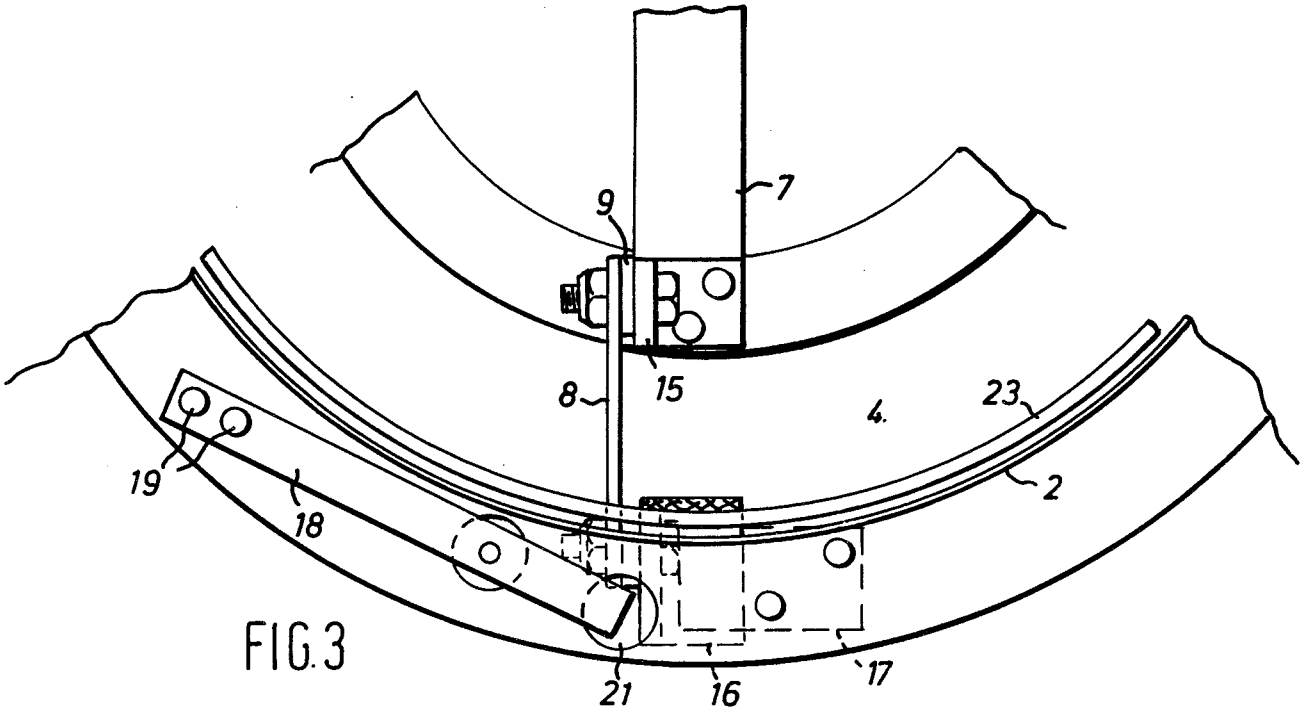
FIG. 3 is an enlarged view of detail "A" of FIG. 1.

Each parallelogram linkage 6 comprises two flat longitudinal arms 8 arranged juxtaposed in a plane, and two shorter arms 9 which pivotably interconnect the respective adjacent ends of the longitudinal arms 8 by means of four bolts 10 each of which passes transversely through one longitudinal arm 8 and one shorter arm 9. The two longitudinal arms 8 are arranged in a plane which is parallel to the axis of the diffuser, such that the longitudinal arms 8 are disposed one above the other with the diffuser installed in the ceiling. Each bolt 10 carries a bearing bush 11 (upper half of FIG. 5) for the adjacent ends of the longitudinal arm 8 and the transverse arm 9, and the arm ends are clamped together by means of a nut 12 with the interposition of a crinkled washer 13. A further crinkled washer (not shown) may be located between the adjacent arm ends, and conventional flat washers (not shown) may additionally be provided between the bolt head 10' and between the nut 12 and the respective adjacent arms 9 and 8 of the linkage 6. In this embodiment the crinkled washer 13 constitutes a friction inducing means acting on the two arms, the friction force being adjustable by tightening or loosening the nut 12.

In another embodiment (lower half of FIG. 5), the friction inducing means is constituted by a bush 14 of a suitable metal or plastics which can be axially compressed, by tightening the nut 12, and thus radially expanded to provide a friction force acting on the two arms 8 and 9.

Figure 2:
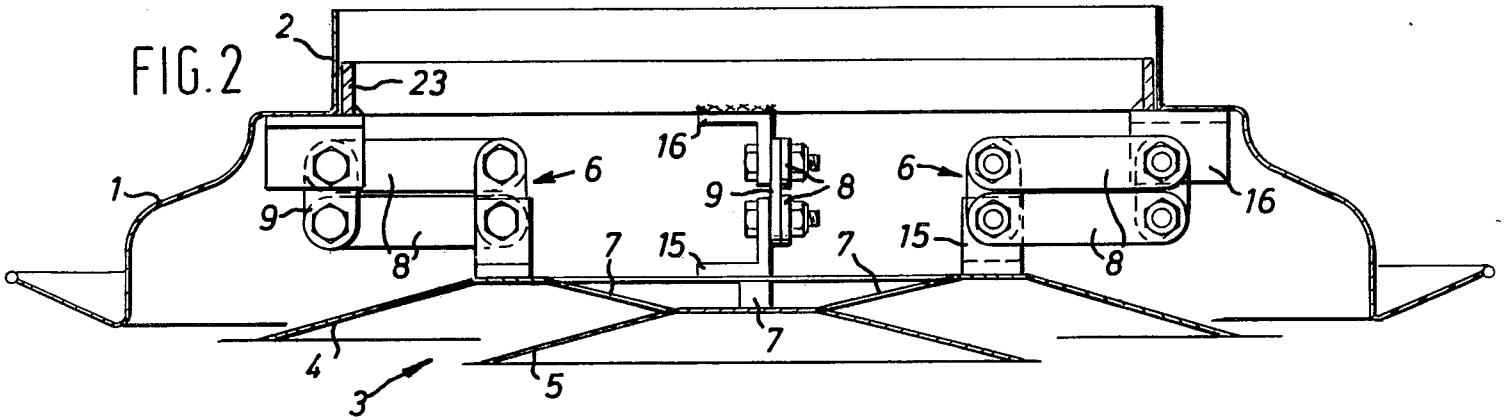
FIG. 2 is a cross-section on the line II—II of FIG. 1.

Each parallelogram linkage 6 extends substantially radially of the axis of the diffuser and is mounted at one end on a right-angled bracket 15 secured by its horizontal arm to the diffuser cone 7 adjacent the inner periphery on its surface facing away from the frusto-cone 5. The connection to the bracket 15 is effected at one vertex of the parallelogram by the lower bolt 10 (as viewed in FIG. 2) which, for this purpose, is made slightly longer than the adjacent upper bolt 10 to accommodate the thickness of the free vertical bracket arm.

At the diagonally opposite vertex the parallelogram linkage is mounted in a similar manner on a right-angled bracket 16 with the upper bolt 10 having an extended length. Each of the brackets 16 slidingly engages an anchoring bracket 17 which is secured to the outer cone 1 adjacent its inner periphery on the side facing the inner cone assembly 3. Four such anchoring brackets are provided and are angularly uniformly spaced apart on the outer cone 1. The four brackets 17 are engaged simultaneously by the rotation of the inner cone assembly in the appropriate direction until the upper right-angled brackets 16 are in full engagement by their free horizontal arms with the brackets 17.

To secure the inner cone assembly 3 in angular position relative to the outer cone 1, a resilient catch in the form of a leaf spring 18 is provided at least adjacent one of the anchorages. The leaf spring 18 is secured at one end by means of rivets 19 to the outer cone 1 adjacent its inner periphery and has its other end bent inwardly as at 20 and engaging a hole 21 in said periphery so that the bent end 20 comes to lie behind the right-angled bracket 16. Intermediate its ends the spring 18 has an operating button 22 which projects downwardly through the outer cone 1.

In order to disconnect the inner cone assembly 3 from the outer diffuser cone 1, the resilient catch is released by pressing the button 22 with the leaf spring 18 upwards until its bent end is clear of the hole 21 and then rotating the inner cone assembly 3 in the opposite direction to disengage the right-angled brackets 16 from the anchoring brackets 17.

The annular cones 1 and 4 and the frusto-cone 5 of the diffuser are preferably made of spinnings or pressings from steel or aluminium. The walls of the diffuser cones may be flat or convexly curved. The supporting arms 7 and the brackets 15, 16 and 17 are preferably secured to the cone members by means of rivetting or welding. In order to facilitate initial positioning of the inner cone assembly 3 relative to the outer cone 1, a centring or locating ring 23 is welded to the horizontal arms of the angled brackets 16, which ring is so dimensioned as to slidingly engage the neck 2 of the cone 1 from the interior thereof when the cone assembly 3 is brought towards the inner periphery of the outer cone 1.

Whilst in the embodiment described four linkage devices 6 have been provided, it is to be understood that fewer, for example three, or more for example five or six such devices may be employed. However, for reasons of satisfactory stability during adjustment of the inner cone assembly relative to the outer cone and the satisfactory maintenance of the adjusted position at least four parallelogram linkage devices are preferably provided.

I claim:

1. A circular diffuser for ventilating systems, comprising a fixedly mountable outer diffuser cone, an inner diffuser cone assembly movably mounted within said outer diffuser cone for adjustment co-axially thereto and including at least one diffuser cone of smaller dimensions than said outer diffuser cone, and parallelogram linkage devices each pivotally connecting respectively at solely two diagonally opposite vertices the inner diffuser cone assembly to the outer diffuser cone, the remaining diagonally opposite vertices being free, and including friction inducing means, whereby to cause the inner cone assembly to remain in position after effecting an adjustment thereof relative to the outer diffuser cone.

2. A circular diffuser as claimed in claim 1, wherein at least three said parallelogram linkage devices are provided which are arranged in uniformly spaced apart angular relationship.

3. A circular diffuser as claimed in claim 2, wherein each parallelogram linkage device comprises two flat longitudinal arms juxtaposed in a plane which is parallel to the diffuser axis, and two shorter arms, and bolt and nut assemblies which interconnect pivotably the respective adjacent ends of the longitudinal arms, each bolt of said bolt and nut assemblies passing transversely through one longitudinal arm and one shorter arm.

4. A circular diffuser as claimed in claim 3, wherein each parallelogram linkage device is pivotably mounted at one end or vertex by means of one said bolt and nut assembly on an angle bracket secured to the inner diffuser cone assembly and at the other end by means defining a diagonally opposite vertex of one further said bolt and nut assembly on a further angle bracket which slidably engages in an anchoring bracket secured to the outer diffuser cone.

5. A circular diffuser as claimed in claim 4, wherein at least one releasable catch in the form of a leaf spring is provided which is attached at one end to the outer diffuser cone for securing the inner cone assembly in position within the anchoring brackets said spring abutting at the free end one of the brackets of the inner cone assembly.

6. A circular diffuser as claimed in claim 3, wherein the friction inducing means are constituted by crinkled washers which are carried by said bolt and nut assemblies.

7. A circular diffuser as claimed in claim 3, wherein the friction inducing means are constituted by axially compressible bushes which are carried by said bolt and nut assemblies.

* * * * *